US009831612B1

(12) United States Patent
Szeremeta

(10) Patent No.: US 9,831,612 B1
(45) Date of Patent: Nov. 28, 2017

(54) HIGH SPEED ELECTRICAL CONNECTOR WITH IMPROVED EMI SUPPRESSION AND MECHANICAL RETENTION SHIELD

(75) Inventor: Wojciech Szeremeta, Mission Viejo, CA (US)

(73) Assignee: Western Digital Technologies, Inc., San Jose, CA (US)

( * ) Notice: Subject to any disclaimer, the term of this patent is extended or adjusted under 35 U.S.C. 154(b) by 561 days.

(21) Appl. No.: 12/852,417

(22) Filed: Aug. 6, 2010

(51) Int. Cl.
*H01R 13/648* (2006.01)
*H01R 13/658* (2011.01)
*H01R 12/50* (2011.01)

(52) U.S. Cl.
CPC ... *H01R 13/65802* (2013.01); *H01R 23/6873* (2013.01)

(58) Field of Classification Search
CPC ..... H01R 23/6873; H01R 13/65802
USPC ... 439/607.25, 607.28, 607.35, 541.5, 540.1, 439/101.108
See application file for complete search history.

(56) References Cited

U.S. PATENT DOCUMENTS

| | | | | |
|---|---|---|---|---|
| 5,637,015 | A * | 6/1997 | Tan et al. | 439/607.37 |
| 6,238,241 | B1 * | 5/2001 | Zhu et al. | 439/607.01 |
| 6,346,009 | B1 * | 2/2002 | Lin | 439/607.01 |
| 6,394,841 | B1 * | 5/2002 | Matsuura | 439/607.23 |
| 6,688,915 | B2 * | 2/2004 | Moriwake et al. | 439/607.05 |
| 6,835,092 | B2 * | 12/2004 | Wan et al. | 439/607.01 |
| 7,156,672 | B2 * | 1/2007 | Fromm et al. | 439/101 |
| 7,517,253 | B1 | 4/2009 | Chiang | |
| 7,534,143 | B1 | 5/2009 | Tsao et al. | |
| 7,604,512 | B1 | 10/2009 | Chen | |
| 8,172,585 | B2 * | 5/2012 | Chiu et al. | 439/108 |
| 2005/0181671 | A1 * | 8/2005 | Hu et al. | 439/607 |
| 2006/0014431 | A1 * | 1/2006 | Shuey et al. | 439/607 |
| 2006/0084301 | A1 * | 4/2006 | Fromm et al. | 439/101 |
| 2009/0042451 | A1 * | 2/2009 | He et al. | 439/660 |
| 2009/0111330 | A1 | 4/2009 | Lin et al. | |
| 2009/0305532 | A1 | 12/2009 | Hou et al. | |
| 2010/0015855 | A1 | 1/2010 | Chiang | |
| 2010/0022138 | A1 | 1/2010 | Miyoshi et al. | |
| 2010/0068939 | A1 | 3/2010 | Xu et al. | |

* cited by examiner

*Primary Examiner* — Briggitte R Hammond
(74) *Attorney, Agent, or Firm* — Chang & Hale LLP

(57) ABSTRACT

The embodiments of the present invention provide a shielded connector having improved shielding effectiveness to reduce electromagnetic interference (EMI). Some of the various embodiments provide high-speed electrical connectors capable of carrying gigabyte data rate signals. The shielding may employ, among other things, one or more shielding structures to reduce the EMI associated with these and other signals. The shielding structures may be oriented to reduce or limit the apertures within the connector through which EMI can penetrate. For example, some embodiments for a universal serial bus (USB) connector may support both a USB 3.0 and USB 2.0. For these embodiments, a grounding tab or peg may be placed in the rear of the connector between the USB 3.0 and the USB 2.0 connections to divide the aperture for the port into a plurality of sections. The grounding tab or peg may also serve as a structural support for the connector.

19 Claims, 11 Drawing Sheets

HIGH SPEED ELECTRICAL CONNECTOR WITH IMPROVED EMI SUPPRESSION AND MECHANICAL RETENTION SHIELD

DESCRIPTION OF THE EMBODIMENTS

Field

Embodiments of the present disclosure relate to shielding, and more particularly, the embodiments relate to shielding for a connector that prevents electromagnetic interference.

BACKGROUND

Today, devices, such as consumer electronics, are exposed to a plethora of electromagnetic interference. Electromagnetic interference can adversely affect the performance of these devices especially devices that handle high frequency data signals. Accordingly, most such devices typically comprise at least one shielding enclosure.

However, electronic devices must typically include features such as apertures, slots, cabling, connector ports, and the like in order to connect to other devices. In addition, openings or breaks in the shielding enclosure may be needed for cooling or ventilation of the electronic components. These features cause openings or breaks in the shielding enclosure through which electromagnetic interference can penetrate. Thus, the design of such features can be important to the performance of the device.

In high-frequency data transfer applications, it is becoming very challenging to keep electromagnetic emission within acceptable limits, especially without the need for an external shielding. Various mechanical shield designs and EMI suppressing tapes have been used in electronic devices. These solutions, however, are often inadequate in sufficiently reducing electromagnetic interference and increase the cost of the product.

SUMMARY

In accordance with an embodiment of the present invention, a universal serial bus (USB) connector comprises a housing configured to accept at least one male USB connector and connect the USB connector to a set of electrical connections. The connector also comprises a shielding shell, coupled to the housing, comprising a set of structures for mounting the connector and defining a plurality of apertures through which the set of electrical connections may pass. The shielding shell includes at least one grounding structure configured to reduce electromagnetic interference (EMI) generated from signals over the set of electrical connections.

In accordance with another embodiment of the present invention, a female USB connector comprises an insulative housing having a front side and a rear side, an electrically conductive shell, a first set of contacts, and a second set of contacts. The electrically conductive shell encloses the insulative housing and cooperates with the insulative housing to define a front receiving cavity adapted for receiving a complementary male USB connector and a set of apertures on the rear side. The first set of contacts are held in the insulative housing and are provided for transmitting a first set of signals carrying data at a first data rate, wherein the first set of contacts have respective portions exposed in the receiving cavity and extending rearward through a first aperture on the rear side. The second set of contacts are held in the insulative housing and are provided for transmitting a second set of signals carrying data at a second rate that is higher than the first data rate, wherein the second set of contacts have respective portions exposed in the receiving cavity and extending rearward through a second aperture on the rear side. The first and second apertures are separated by a grounding structure that extends from the electrically conductive shell.

Additional features of the embodiments will be set forth in part in the description which follows, and in part will be obvious from the description, or may be learned by practice of the embodiments. The advantages of the embodiments can be realized and attained by means of the elements and combinations particularly pointed out in the appended claims.

It is to be understood that both the foregoing general description and the following detailed description are exemplary and explanatory only and are not restrictive of the embodiment, as claimed.

BRIEF DESCRIPTION OF THE DRAWINGS

The accompanying drawings, which are incorporated in and constitute a part of this specification, illustrate embodiments of the invention and together with the description, serve to explain the principles of the embodiment. In the Figures.

DESCRIPTION OF THE EMBODIMENTS

The embodiments of the present invention provide a shielded connector having improved shielding effectiveness to reduce electromagnetic interference (EMI). Some of the various embodiments provide high-speed electrical connectors capable of carrying very large (e.g., gigabyte and higher) data rate signals. The shielding may employ, among other things, one or more shielding structures to reduce the EMI associated with these and other signals. The shielding structures may be configured, or oriented, to reduce or limit the exposure to apertures within the connector through which EMI can penetrate. For example, some embodiments for a universal serial bus (USB) connector may support a USB 3.0 connector, USB 2.0 connector, or both. For these embodiments, a grounding tab or peg may be placed in the rear of the connector between the USB 3.0 and the USB 2.0 connections to divide the aperture for the port into a plurality of sections. The grounding tab or peg may also serve as a structural support for the connector.

For purposes of illustration, embodiments for a USB connector, such as a connector supporting USB 3.0, is described to illustrate the principles of the invention. One skilled in the art will recognize that the various embodiments can be applied to other types of connectors. Reference will now be made in detail to exemplary embodiments of the invention, an example of which is illustrated in the accompanying drawings. Wherever possible, the same reference numbers will be used throughout the drawings to refer to the same or like parts.

Figure 1:
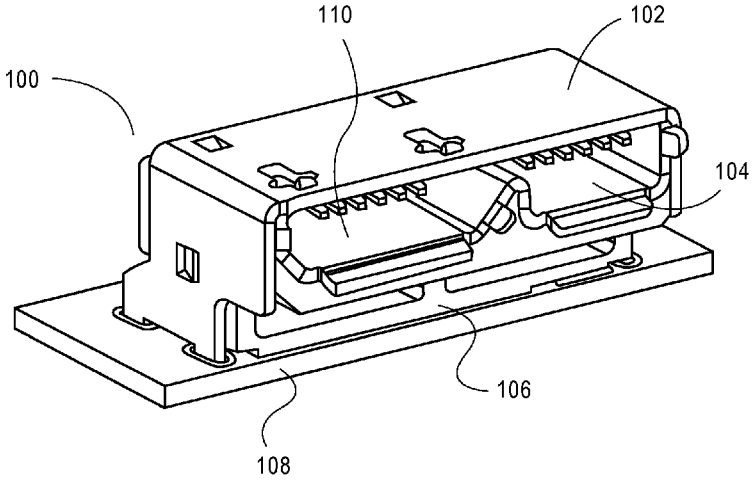
FIG. 1 is a front perspective view of a connector according to an embodiment of the present invention.
Figure 2A:
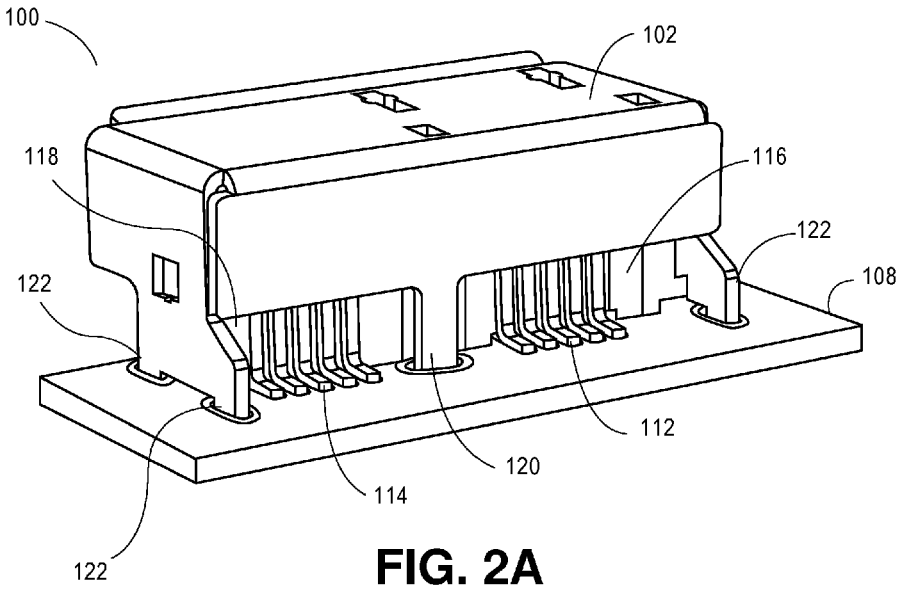
FIG. 2A is a rear perspective view of the connector of FIG. 1 according to an embodiment of the present invention.
Figure 2B:
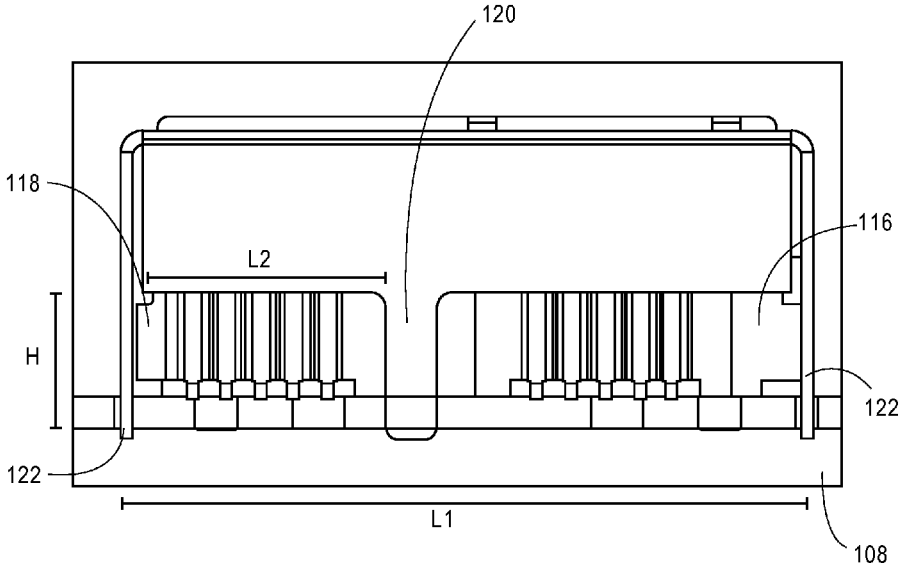
FIG. 2B shows a rear planar view of the connector of FIG. 1 according to an embodiment of the present invention.
Figure 2C:
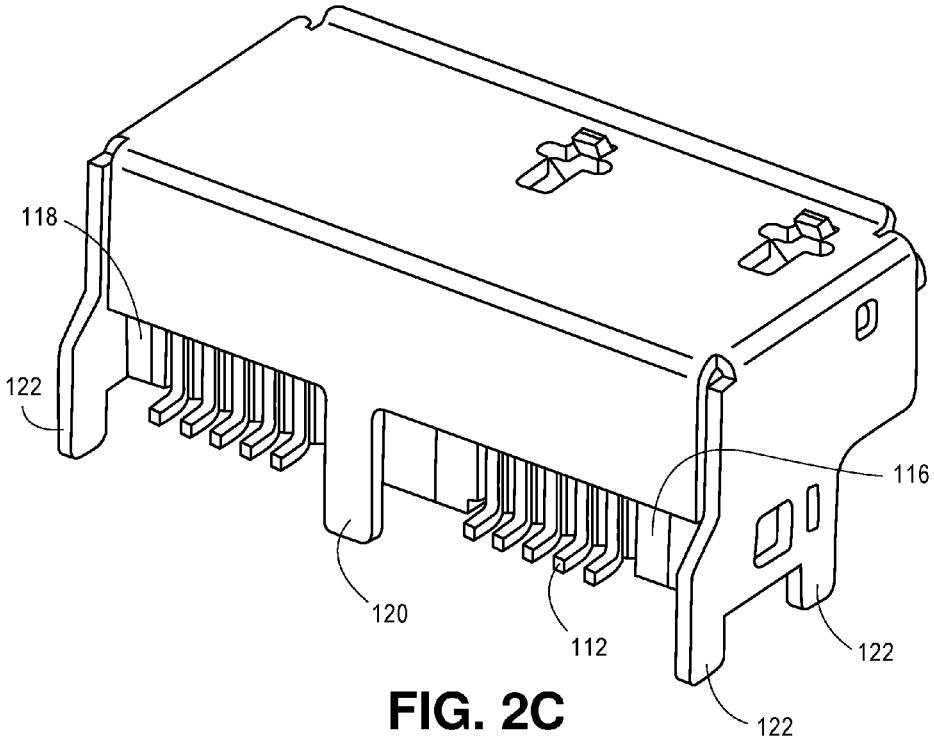
FIG. 2C shows another rear perspective view of the connector according to an embodiment of the present invention.
Figure 3:
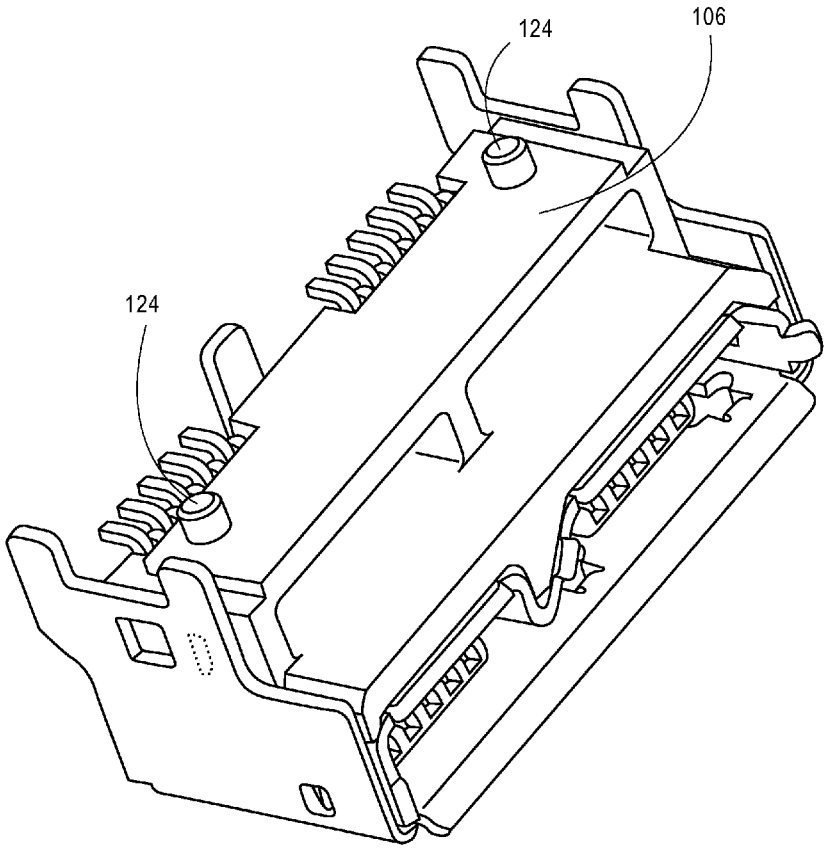
FIG. 3 shows a bottom perspective view of the connector according to an embodiment of the present invention.
Figure 8:
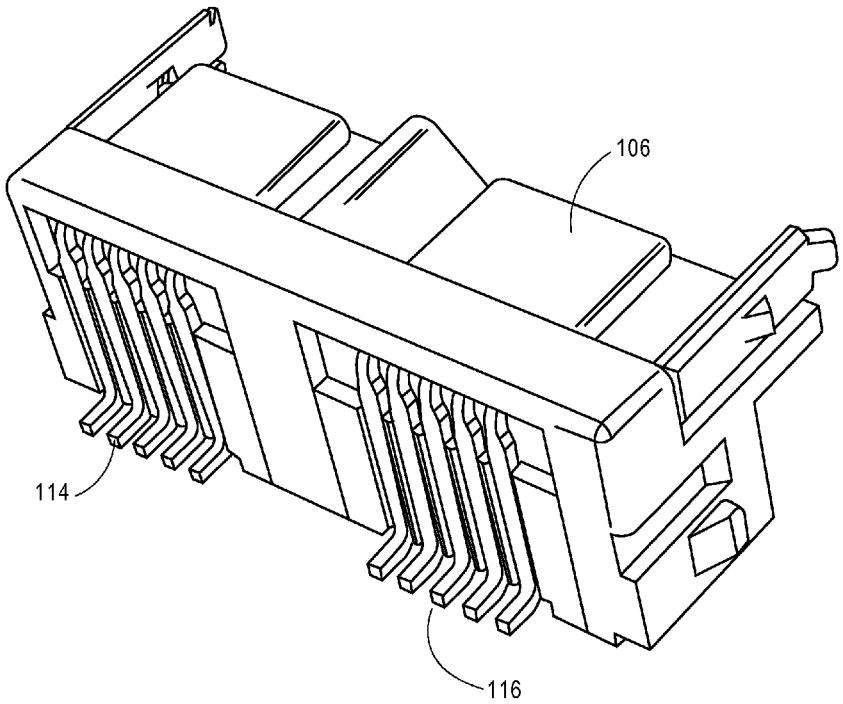
FIG. 8 shows an exemplary housing with contact pins installed for an embodiment of the present invention.
Figure 9:
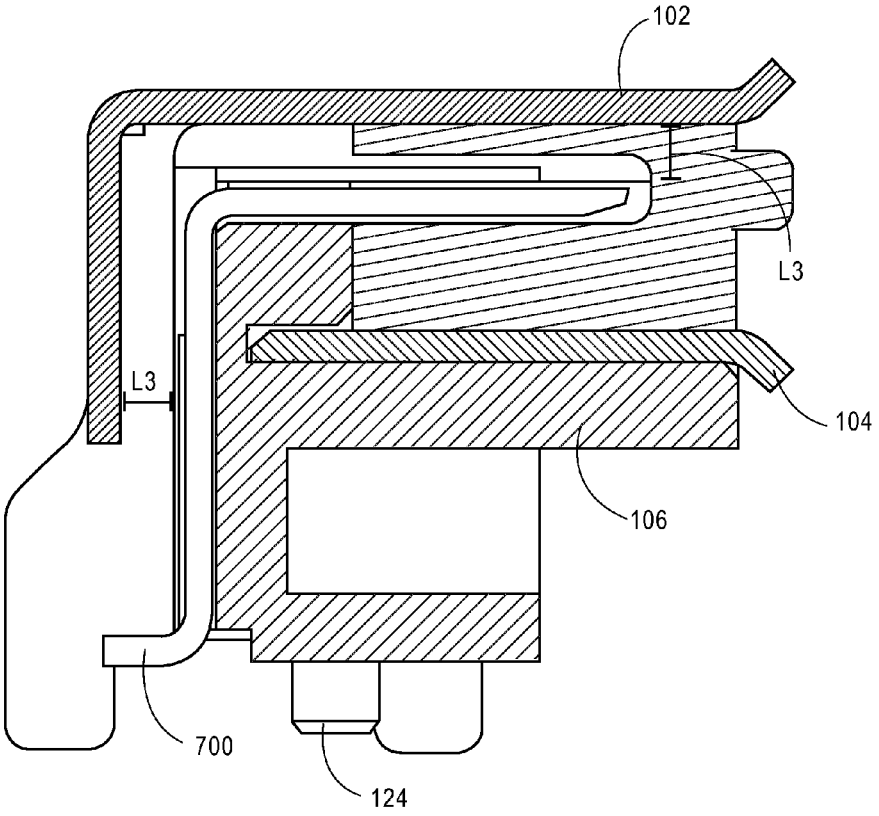
FIG. 9 shows a cutaway side view of a connector according to an embodiment of the present invention.

In the Figures, FIG. 1 provides a front perspective view of an exemplary connector of the present invention. FIGS. 2A-2C show rear views of the connector and illustrate the shielding/grounding structure of the present embodiment. FIG. 3 shows a bottom perspective view of the connector. FIGS. 4-7 show examples of the major components of the connector. FIG. 8 shows the connector without its shielding enclosure. And, FIG. 9 shows a cutaway side view to illustrate the matched impedance geometry of the connector pins employed in the connector. Reference will now be made to these figures beginning with FIG. 1.

FIG. 1 is a front perspective view of a connector 100 according to an embodiment of the present invention. In the embodiment shown, connector 100 is a female USB connector that can accommodate both USB 3.0 and USB 2.0 connections. As shown, connector 100 may comprise an upper, external shield 102, a lower, internal shield 104, and a housing structure 106. The upper and lower shields 102, 104 and the housing structure 106 are components that may collectively be constructed together to form the connector 100 proper.

For example, the upper shield 102 and lower shield 104 may be welded, such as laser welded, together to form a shielding shell around the housing structure 106. Accordingly, in assembled form as a female USB, the connector 100 provides a receiving cavity (or opening) 110 to accept complimentary male USB connectors.

For purposes of illustration, the connector 100 is shown mounted on to a printed circuit board 108 to show how connector 100 may be implemented within an electronic device (not shown). The components of connector 100 will now be further described.

External shield 102 serves as part of the shielding shell and provides shielding for the connector 100. External shielding 102 may be constructed from a low impedance material, such as a metal. In some embodiments, external shield 102 is produced from a sheet metal material to facilitate production. The dimensions of external shield 102 may be based on a variety of factors, such as, dimensions needed for the connector engagement, allowance for rework during manufacturing, and the like.

Internal shield 104 of the shielding shell serves as a complimentary part to external shield 102 and also may provide shielding for the connector 100. Internal shield 104 may be constructed from a low impedance material, such as a metal. Likewise, internal shield 104 may be produced from a sheet metal material.

Housing 106 provides the structural foundation for connector 100. In some embodiments, the housing 106 is constructed from an insulative material, such as plastic. For example, as noted above, housing 106 may be configured and shaped for a female USB connector. In the embodiment shown, the housing 106 is configured to accept a USB 3.0 and USB 2.0 connector in a side-by-side configuration. Of course, connector 100 and housing 106 may be configured to accommodate other types of connectors and other types of arrangements within the principles of the present invention.

FIG. 2A is a rear perspective view of the connector 100 according to an embodiment of the present invention. As shown, the connector 100 may comprise a first set of contacts 112 and a second set of contacts 114. In the embodiment shown, the first set of contacts 112 carry USB 2.0 data signals while the second set of contacts 114 may carry USB 3.0 data signals. Accordingly, connector 100 may provide apertures 116 and 118 through which contacts 112 and 114 may be exposed for electrical contact, e.g., in order to connect to other components of an electronic device.

In addition, connector 100 may comprise a shielding grounding structure 120 and mounting structures 122. In the embodiment shown, shielding grounding structure 120 may be a peg-like structure that extends from external shield 102 for attachment to a through-hole provided in board 108. In the embodiment shown, shielding grounding structure 120 is shown as a single, solid structure. In other embodiments, shielding grounding structure 120 may comprise multiple structures and features. For example, shielding grounding structure 120 may comprise two or more peg-like structures, or a single peg-like structure with a slit cut in it. In addition, in one embodiment, the shielding grounding structure 120 may be positioned in proximity to the second set of contacts 114 to assist in reducing EMI generated by the USB 3.0 signals.

Mounting structures 122 may be structures that extend from external shield 102 and provide a retention and grounding feature for connector 100. For example, mounting structures 122 may be provided at the corners of external shield 102 and configured as peg-like structures that extend from the external shield 102 and configured for attachment to respective through-holes provided in the printed circuit board 108. Of note, shielding grounding structure 120 can provide additional retention strength and grounding paths that compliment mounting structures 122.

FIG. 2B shows a rear view of the connector 100 according to an embodiment of the present invention. The rear of connector 100 provides an overall opening having a length L1 and height H. In addition, shielding grounding structure 120 essentially divides this overall opening into a first aperture 116 and a second aperture 118. Second aperture 118 may thus have a length of L2. An explanation of how shielding grounding structure 120 improves EMI suppression of connector 100 will now be provided.

The ability of a shield to reduce EMI or improve the immunity of a device to EMI and other high frequency interference can be characterized by a parameter known as shielding effectiveness (SE). In the embodiments, the shielding shell formed from upper shield 102 and lower shield 104 may be configured to achieve a desired SE. SE can be defined as the ratio of the strength of an EMI field within two different enclosures. For convenience, SE can be expressed in units of decibels according to the formula:

$SE=20\log(\lambda/2L)$, where $\lambda$ is the wavelength of the signal and L is the length of the aperture being studied. For USB 3.0 signals, a frequency of about 3-5 GHz is relevant, which results in a $\lambda$ range that is approximately 60-100 mm.

As noted above, connector 100 provides an overall opening having a length L1 and a height H. In the absence of shielding grounding structure 120, connector 100 thus provides an aperture of L1 by H through which EMI generated by the USB 2.0 and USB 3.0 signals may emanate. In some embodiments, connector 100 may provide a total aperture length L1 of about 13 mm. As to the height H, it may be configured based on providing an opening of about $1/20^{th}$ of the relevant wavelength λ, while also allowing sufficient clearance for re-work (if needed). In the present disclosure, it was discovered that the USB 3.0 signals, due to their higher frequency, were generating EMI that would affect the performance of an electronic device. As noted above, conventional solutions, such as grounding tape, and the like, were either cost prohibitive or ineffective in reducing the EMI to sufficient levels.

With shielding grounding structure 120 in place, however, the aperture of otherwise unshielded connector 100 is structurally compartmentalized or physically separated into two (or more) smaller apertures, i.e., apertures 116 and 118. As shown, aperture 116 may have a length L2 and also a height H. In some embodiments, shielding grounding structure 120 was placed to provide a length L2 of about 4-5 mm to place the structure in proximity to the USB 3.0 signals, while also providing sufficient clearance for re-work (if needed). For example, in one embodiment, shielding grounding structure 120 was placed to provide a length L2 of 4.8 mm for aperture 118.

Referring now back to the equation above, the shielding effectiveness (SE) of connector 100 as it relates especially to EMI for USB 3.0 signals may now be studied. In particular, since both apertures have the same height in the embodiment, the SE of the embodiment shown essentially varies based on the lengths of the relevant apertures. Accordingly, assuming L1=13 mm and L2=4.8 mm, the SE for each scenario becomes:

Without shielding grounding structure 120, L1=13 mm, thus . . . .

SE=20 log(100 mm/(2×13 mm))

SE=11.7 dB

With shielding grounding structure 120, L2=4.8 mm, thus . . .

SE=20 log (100 mm/(2×4.8 mm))

SE=20.2 dB

Accordingly, based on these and other calculations as well as testing, the embodiments of the present invention were found to dramatically improve EMI suppression, e.g., by over 8 dB, of the connector 100.

FIG. 2C shows another rear perspective view of the connector 100 according to an embodiment of the present invention. In particular, the connector 100 is shown unmounted. As shown, the shielding grounding structure 120 and mounting structures 122 may extend from external shield 102 and may be shaped as peg-like structures for attachment to respective through-holes in a printed circuit board 108 (not shown in FIG. 2C). Of course, other types of retention features, such as one or more tabs, fingers, knobs, protrusions, or other shaped members may be used in conjunction with corresponding mating receiving holes on the printed circuit board, and may be employed by the embodiments of the present invention.

Shielding grounding structure 120 may be configured with different shapes. For example, shielding grounding structure 120 may have various depths, widths, and lengths depending on the EMI characteristics or manufacturing characteristics desired. In addition, shielding grounding structure 120 may have various features, such as curves, surface treatments, and other shapes, depending on the desired features.

FIG. 3 shows a bottom perspective view of the connector 100 according to an embodiment of the present invention. In particular, as shown, the housing 106 may comprise registration features 124. Registration features 124 may be provided to assist in mounting of connector 100 to printed circuit board 108.

Figure 4:
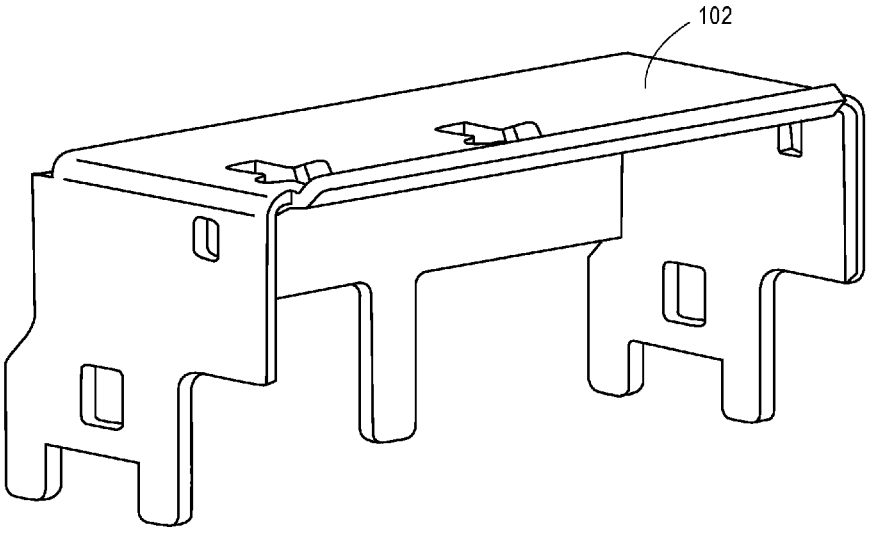
FIG. 4 shows an exemplary external shield for an embodiment of the present invention.
Figure 5:
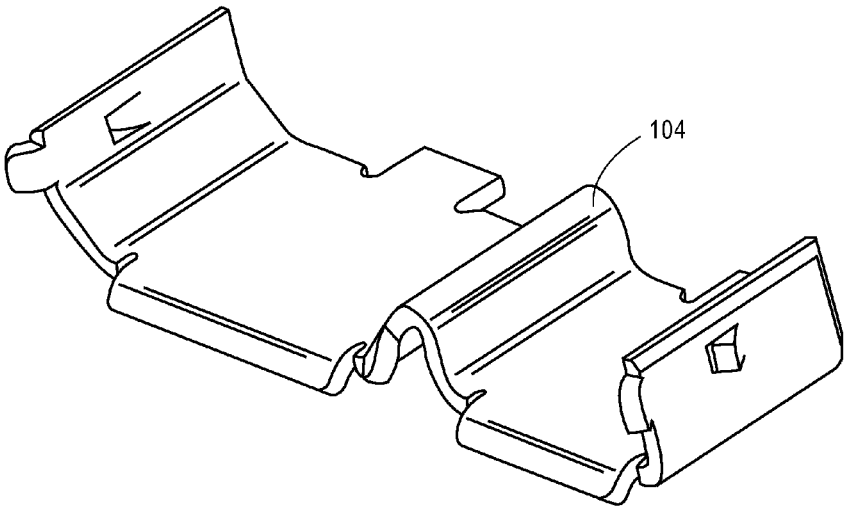
FIG. 5 shows an exemplary internal shield for an embodiment of the present invention.
Figure 6:
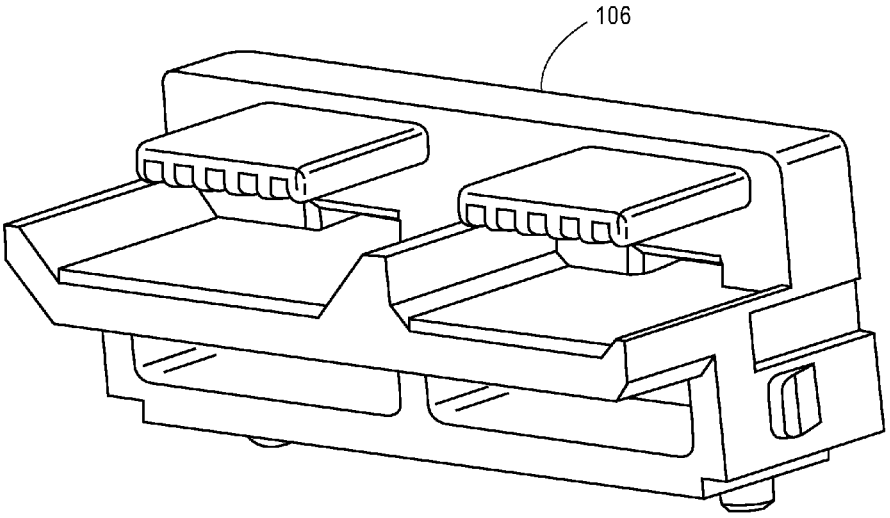
FIG. 6 shows an exemplary housing for an embodiment of the present invention.

FIG. 4 shows an exemplary external shield 102 for an embodiment of the present invention. FIG. 5 shows an exemplary internal shield 104 for an embodiment of the present invention. FIG. 6 shows an exemplary housing 106 for an embodiment of the present invention.

Figure 7:
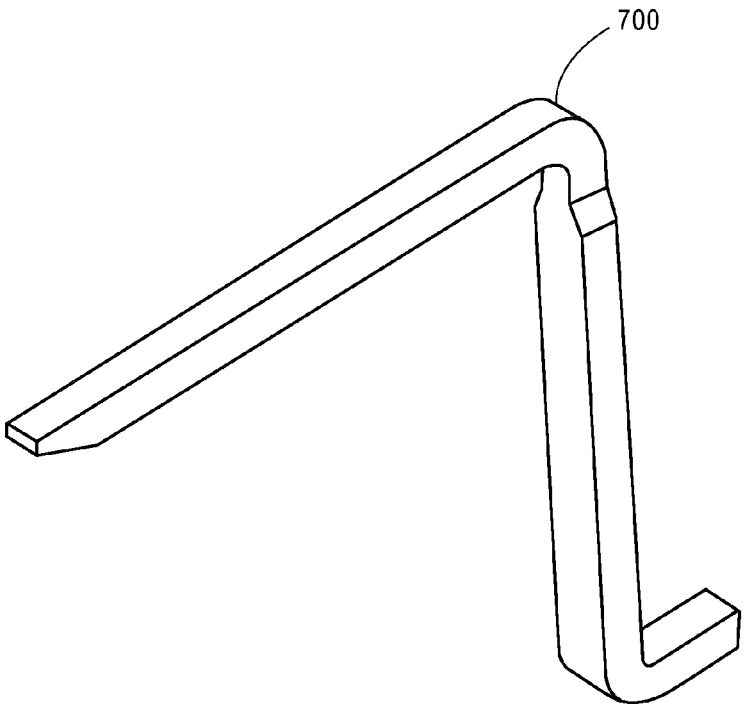
FIG. 7 shows an exemplary contact pin for an embodiment of the present invention.

FIG. 7 shows an exemplary contact pin 700 for an embodiment of the present invention. As noted, connector 100 may comprise sets of contacts 112 and 114 to carry data signals, such as USB 2.0 and USB 3.0 signals. As shown, contact pin 700 may have a geometry to provide for a matched impedance for carrying signals through the connector 100.

FIG. 8 shows an exemplary housing 106 with contact pins 700 installed for an embodiment of the present invention. As shown, housing 106 may separate or compartmentalize contact pins 700 into sets 114 and 116 to carry USB 2.0 and USB 3.0 signals, respectively.

FIG. 9 shows a cutaway side view of the connector 100 according to an embodiment of the present invention and to illustrate the matched impedance geometry of contact pin 700. In particular, as shown, contact pin 700 is predominantly spaced the same distance L3 from external shield 102. This spacing geometry provides for a matched capacitance impedance shield, and thus, also improves the shielding of the connector 100.

It is contemplated that any number of grounding structures and mounting structures may be provided with the shielding shell of the present invention. Although a single grounding structure 120 is shown in the embodiment described herein, it is understood that two or more grounding structures may also be provided, in order to provide additional physical barriers and further compartmentalize or separate the set of contacts 112, 114 from one another. One skilled in the art will recognize that the number of grounding structures 120 that can be employed is limited by the physical exposure required of each aperture to allow the set of contacts 112, 114 sufficient room to attach to other electrical devices.

Further, as previously mentioned, the grounding structures 120 may be formed of any shape or size, so long as the structures 120 are capable of providing sufficient physical barriers to EMI for the apertures. As shown and described above, the grounding structure 120 extends from the external shield 102. However, the grounding structure 120 may also be formed as a separate component and attached to the shielding.

Other aspects of the embodiment will be apparent to those skilled in the art from consideration of the specification and practice of the embodiment disclosed herein. It is intended that the specification and examples be considered as exemplary only, with a true scope and spirit of the embodiment being indicated by the following claims.

What is claimed is:

1. A female USB connector, comprising:

an insulative housing defining first and second female USB receptacles;

an electrically conductive shell enclosing the insulative housing and defining a front receiving cavity providing access to the first and second USB receptacles and first and second apertures on a rear side of the electrically conductive shell;

a first set of contacts held in the insulative housing for transmitting signals at a first data rate, wherein the first set of contacts have respective portions exposed in the front receiving cavity and extending rearward through the first aperture; and a second set of contacts held in the insulative housing for transmitting signals at a second data rate that is higher than the first data rate, wherein the second set of contacts have respective portions exposed in the front receiving cavity and extending rearward through the second aperture;

wherein:

the first and second apertures are separated by a grounding structure that extends from the electrically conductive shell below the first and second sets of contacts for attachment to a printed circuit board (PCB) through a through-hole of the PCB; and the first and second apertures have a total width of approximately 13-15 mm.

2. The female USB connector of claim 1, wherein the electrically conductive shell comprises an external, upper EMI shield.

3. The female USB connector of claim 1, wherein the electrically conductive shell comprises an internal, lower EMI shield.

4. The female USB connector of claim 1, wherein the first set of contacts transmit USB 2.0 signals.

5. The female USB connector of claim 1, wherein the second set of contacts transmit USB 3.0 signals.

6. The female USB connector of claim 5, wherein the second aperture is approximately 4-5 mm wide.

7. The female USB connector of claim 5, wherein the first aperture is approximately 8-9 mm wide.

8. The female USB connector of claim 1, wherein the grounding structure is an extension of the electrically conductive shell.

9. The female USB connector of claim 8, wherein the grounding structure is a solid, peg shaped structure.

10. The female USB connector of claim 8, wherein the grounding structure is shaped to attach to the through-hole.

11. A universal serial bus (USB) connector comprising:

a housing configured to accept a plurality of male USB connectors and connect the plurality of USB connectors to respective sets of electrical connections, wherein at least one of the sets of electrical connections is configured to carry signals at a higher data rate than another of the sets of electrical connections; and a shielding shell, coupled to the housing, comprising a set of structures for mounting the shell to a printed circuit board (PCB) and defining a plurality of apertures through which the sets of electrical connections for the USB connectors may pass, wherein the shielding shell includes at least one grounding structure separating the plurality of apertures and extending below the sets of electrical connections for attachment to the PCB through a through-hole of the PCB and configured to reduce electromagnetic interference (EMI) generated from signals for the higher data rate carried over the at least one of the set of electrical connections;

wherein at least one of the apertures is approximately 4 to 5 mm wide.

12. The USB connector of claim 11, wherein the housing is electrically insulative.

13. The USB connector of claim 11, wherein the shielding shell comprises an external EMI shield configured to cooperate with the housing to define a receiving opening for the at least one male USB connector.

14. The USB connector of claim 11, wherein the shielding shell comprises an internal EMI shield.

15. The USB connector of claim 11, wherein the housing is configured to accept at least one male USB 3.0 connector.

16. The USB connector of claim 11, wherein the grounding structure provides a physical barrier between the plurality of apertures.

17. The USB connector of claim 11, further including two or more grounding structures.

18. The USB connector of claim 11, wherein the shielding shell is structurally configured to provide a shielding effectiveness of at least 8 dB.

19. The USB connector of claim 11, wherein the shielding shell is structurally configured to provide a shielding effectiveness of electromagnetic interference having a frequency of about 3 to 5 GHz.

* * * * *